US006332846B1

(12) United States Patent
Rennhack

(10) Patent No.: US 6,332,846 B1
(45) Date of Patent: Dec. 25, 2001

(54) DEVICE FOR POSITIONING THE HEAD OF A GOLFER DURING THE GOLF SWING

(76) Inventor: David B. Rennhack, 5840 Sycamore Bend, The Colony, TX (US) 75056

( * ) Notice: Subject to any disclaimer, the term of this patent is extended or adjusted under 35 U.S.C. 154(b) by 0 days.

(21) Appl. No.: 09/398,510

(22) Filed: Sep. 17, 1999

(51) Int. Cl.[7] ..... A63B 57/00
(52) U.S. Cl. ..... 473/208; 473/409
(58) Field of Search ..... 473/207, 208, 473/409

(56) References Cited

U.S. PATENT DOCUMENTS 1,126,051 * 1/1915 Mcgillicuddy ..... 473/208
3,860,246 1/1975 Fish .
5,174,564 12/1992 Young, III .
5,226,712 7/1993 Lucas .
5,473,520 12/1995 Malley .
5,485,357 * 1/1996 Zolninger ..... 362/103
5,651,680 7/1997 Levy .
5,746,663 5/1998 Calace .

* cited by examiner

*Primary Examiner*—Mark S. Graham
*Assistant Examiner*—Raeann Gorden
(74) *Attorney, Agent, or Firm*—Harrison & Egbert

(57) ABSTRACT

A head positioning device for use by a golfer including a mouthpiece and a rigid shaft affixed to and extending outwardly from the mouthpiece. The mouthpiece has a curved configuration. The shaft is affixed to the center of the curved configuration. The shaft extends radially outwardly of the mouthpiece. The shaft is a straight shaft. The mouthpiece has an interior area adapted to be received by teeth of the golfer.

5 Claims, 2 Drawing Sheets

DEVICE FOR POSITIONING THE HEAD OF A GOLFER DURING THE GOLF SWING

TECHNICAL FIELD

The present invention relates to golf swing training devices. More particularly, the present invention relates to devices for positioning and stabilizing the head of the golfer during the golf swing.

BACKGROUND ART

Enthusiasts, as well as professional instructors of the game of golf, unanimously agree that one of the most pressing problems faced in mastering the game is the ability to keep one's head stabilized and in proper position during a full golf swing. By stabilizing and maintaining the proper positioning of the head, the golfer is more likely to swing the club on the proper path during the golf swing. This allows the golfer to become more consistent in their shot making. If the head is improperly lifted or changes positions, as is often the case, the execution of the swing is bound to be faulty. Inconsistent and errant shots are the result.

Although it is necessary to stabilize and maintain the proper position of the head during the golf swing, it is important for the body and head of the golfer to cooperate in a natural manner. Although the head should remain focused on the golf ball during the golf swing, there should not be any restrictions on the movement of the body during the golf swing. However, it is often difficult to determine whether the head is actually moving during the golf swing or whether the body has caused the head to move during the golf swing. It is also important, during golf swings, that the head be in the same position with reference to the ball during the beginning of each golf swing and upon impact with the ball.

In the past, various patents have issued on golf swing training devices which attempt to maintain the head in a fixed position relative to the golf ball. For example, U.S. Pat. No. 1,126,051, issued on Jan. 26, 1915, to J. T. McGillicuddy, describes a golf swing training device which included a mouthpiece which is connected to an elastic member which is, in turn, secured to a belt. The belt would be worn around the torso of the golfer immediately under the arms of the golfer. In this manner, the head could remain in a relatively fixed position during the golf swing.

U.S. Pat. No. 3,860,246, issued on Jan. 14, 1975, to B. M. Fish, teaches a device for aiding a golfer in addressing the ball and in maintaining the golfer's stance during the backswing of the golf club. The device includes a pendulum-type device with a flexible suspension cord with a mouthpiece which is grasped by the mouth of the golfer. At the lower end of the cord is a plumb-bob type of weighted body. This weighted body is intended to be held right over the center of the golf ball so that the user can visually hold his or her head stationary during the backstroke and forward stroke of the golf club. Any movement of the plumb-bob would indicate movement of the golfer's head.

U.S. Pat. No. 5,174,564, issued on Dec. 29, 1992, to J. H. Young III, teaches a swinging and hitting training device for use by athletic participants. This device includes a mouth receiving member for temporary fixed engagement with the head of the user. A strap extends from the mouthpiece and is provided with at least two strap connections. The strap connections have elastic straps with clips at their free extremities for releasable connection to the clothing of the user. During swinging activities, such as hitting golf balls, undesired head movement will impart a force to the resilient straps. The straps will resist such movement of the head of the athlete.

U.S. Pat. No. 5,651,680, issued on Jul. 20, 1997, to C. Levy, describes a golf training system which conditions a golfer to keep his or her head down and straight during a full golf swing. This device alerts the golfer after the execution of each swing whether the previous swing was performed properly. The device includes a cord having a proximal end and distal end. A mouthpiece is secured at the proximal end of the cord. A fastening assembly is secured to the distal end of the cord. The mouthpiece is grasped within the mouth of the golfer. The fastening assembly is secured to an article of the golfer's clothing such that the cord located between the fastening assembly and the mouthpiece is semi-taut when the golfer's head is fixed in a straight downward position. If the fastening assembly disengages from the golfer's clothing during the golf swing, then the golfer is alerted that the execution of his swing was faulty and that he improperly lifted or turned his head.

U.S. Pat. No. 5,746,663, issued on May 5, 1998, to M. A. Calace, teaches a golfing aid which enables a user to maintain a proper head position while executing a swinging motion. A mouthpiece is provided with a rigid support bar which is configured to extend away from the mouthpiece and toward the rear of the user's head. An inflexible connecting member connects the rigid support element to a belt loop or a waistband of the user. In operation, the user will bite down on the mouthpiece and adjust the connecting member such that it is sufficiently taut to prevent the user from moving his head while executing a swing.

In the past, various patents have issued on devices which can be connected to mouthpieces within the mouth of a user. For example, U.S. Pat. No. 5,485,357, issued on Jan. 16, 1996, to G. C. Zolninger, describes a flashlight which is connected to a mouthpiece so that the flash light will extend outwardly of the mouth of the user. A similar device was described in U.S. Pat. No. 5,473,520, issued on Dec. 5, 1995, to K. J. Malley. Similarly, U.S. Pat. No. 5,226,712, issued on Jul. 13, 1993, to R. G. Lucas, also describes a flash light which can be held by the teeth of the user.

It is an object of the present invention to provide a head positioning device which allows the body of the golfer to remain in a natural uncontorted position.

It is another object of the present invention to provide a head positioning device for a golfer which gives a fixed point of reference so that the golfer can more easily tell if his or her head is moving.

It is another object of the present invention to provide a head positioning device which allows the head of the golfer to remain in the same relative position at the beginning of each golf swing.

It is still another object of the present invention to provide a head positioning device which allows the golfer to visualize the proper swing plane.

It is still a further object of the present invention to provide a golf swing training device in which the device does not restrict movement of the head.

It is still a further object of the present invention to provide a head positioning device for a golfer which is easy to use, relatively inexpensive and easy to manufacture.

These and other objects and advantages of the present invention will become apparent from a reading of the attached specification and appended claims.

SUMMARY OF THE INVENTION

The present invention is a head positioning device for use by a golfer which comprises a mouthpiece and a rigid shaft which is affixed to and extends outwardly from the mouthpiece. The mouthpiece will have a curved configuration. The shaft is affixed generally to a center of the curved configuration of the mouthpiece. The shaft will extend radially outwardly of the mouthpiece. The shaft is a straight shaft having a length of between four inches and eighteen inches. The mouthpiece has an interior area adapted to be received by the teeth of the golfer. The shaft will have a diameter less than a thickness of the mouthpiece.

The present invention is also a method of training a golf swing which comprises the steps of: (1) forming a mouthpiece having a straight shaft extending outwardly therefrom; (2) placing the mouthpiece into a mouth of a golfer such that the shaft extends outwardly of the mouth of the golfer; and (3) pointing the shaft toward a golf ball during the golf swing. The head of the golfer is moved until an end of the shaft opposite the mouthpiece is in a line-of-sight between the eyes of the golfer and the golf ball. The shaft is continuously pointed at the golf ball during the golf swing. The mouthpiece may be removed from the mouth of the golfer following the golf swing.

DETAILED DESCRIPTION OF THE INVENTION

Figure 1:
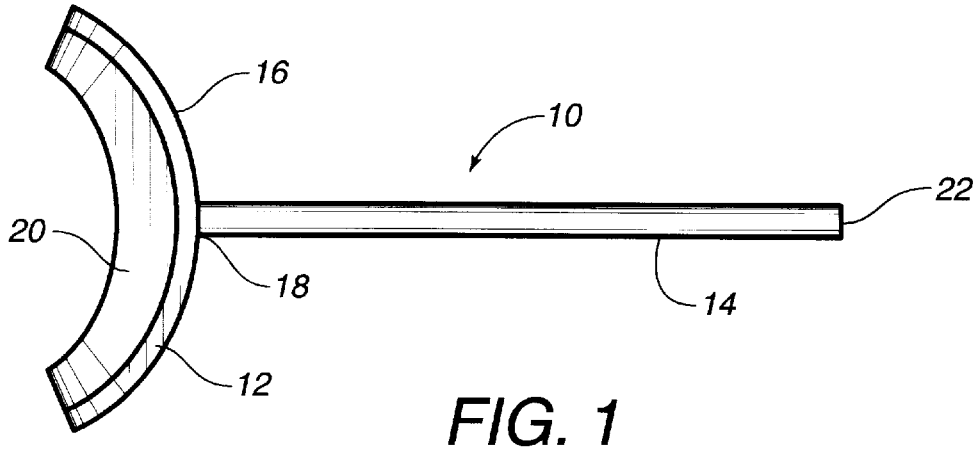
FIG. 1 is a bottom view of the head positioning device in accordance with the teachings of the present invention.

Referring to FIG. 1, there is shown the head positioning device 10 for use by a golfer. The head positioning device 10 includes a mouthpiece 12 and a rigid shaft 14 extending outwardly from the mouthpiece 12. The mouthpiece 12 and the shaft 14 can be formed individually, or integrally together, with a polymeric material.

In FIG. 1, it can be seen that the mouthpiece 12 has a curved outer surface 16. The shaft 14 has a proximal end 18 which is affixed centrally to the curved outer surface 16 of the mouthpiece 12. As such, the shaft 14 will extend radially outwardly from the mouthpiece 12. The mouthpiece 12 has an inner surface 20 which is adapted to be received by the teeth of the golfer. In conventional use, the mouthpiece 12 can be suitably formed in the manner of conventional mouthpieces. In particular, so as to allow the mouthpiece 12 to be adapted to the particular mouth of the golfer, mouthpiece 12 can be formed of a polymeric material such that the polymeric material of the mouthpiece 12 can be suitably heated, placed in the mouth of the golfer and then be molded to the mouth structure of the golfer. By the conventional molding of the mouthpiece 12 to the teeth of the golfer, the golfer can be assured that the mouthpiece 12 will always reside in a identical position whenever the mouthpiece 12 is received by the teeth of the golfer. As a result, the shaft 14 will always extend outwardly in an identical position from the mouth of the golfer.

The shaft 14 has a generally cylindrical configuration. The shaft 14 will have a diameter which is less than the thickness of the mouthpiece 12. The shaft 14 has a distal end 22 opposite the curved surface 16 of the mouthpiece 12. The distal end 22 can be a flat surface or can be a point. In actual use, the distal end 22 will reside in the line-of-sight between the golfer's eyes and the golf ball. The shaft 14 will have a length of between four inches and eighteen inches. If the shaft 14 has a length less than four inches, then the golfer may become cross-eyed when focusing on the distal end 22. If the shaft 14 should have a length greater than eighteen inches, the shaft 14 could interfere with the golfer's swing. Additionally, a lengthy shaft makes it difficult to control the flexing of the shaft 14 during the golf swing. It is important that the shaft 14 have minimal weight and can be comfortably supported by the teeth of the golfer.

Figure 2:
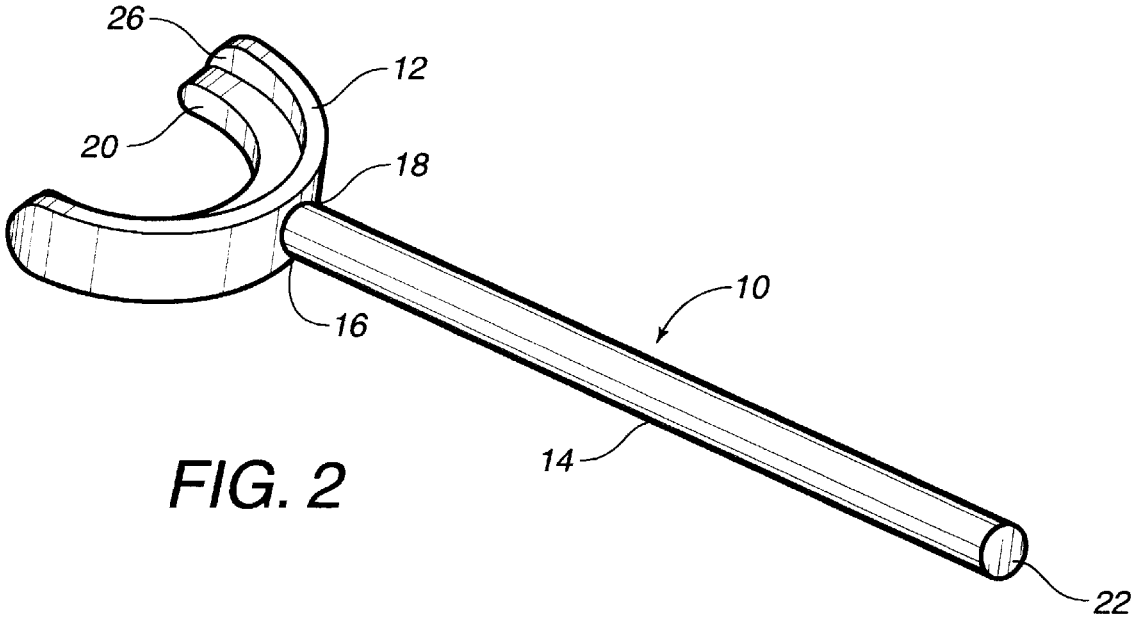
FIG. 2 is an upper perspective view of the head positioning device of the present invention.

FIG. 2 is an upper perspective view showing the head positioning device 10 in accordance with the teachings of the present invention. As can be seen, the mouthpiece 12 has a generally curved outer surface 16. The proximal end 18 of the shaft 14 is secured to this curved outer surface 16. The distal end 22 of the shaft 14 will extend outwardly from the curved surface 16 by the length of the shaft 14. The inner surfaces 20 of the mouthpiece 12 includes a slotted area 26 suitable for the receipt of the teeth of the golfer. As such, the mouthpiece 12 can be placed into the mouth of the golfer such that the teeth reside in the slotted area 26. Inner surface 20 will reside on the inner surface of the mouth while the outer surface 16 will be positioned between the lips and the teeth. The shaft 14 will extend centrally out of the mouth of the golfer.

Figure 3:
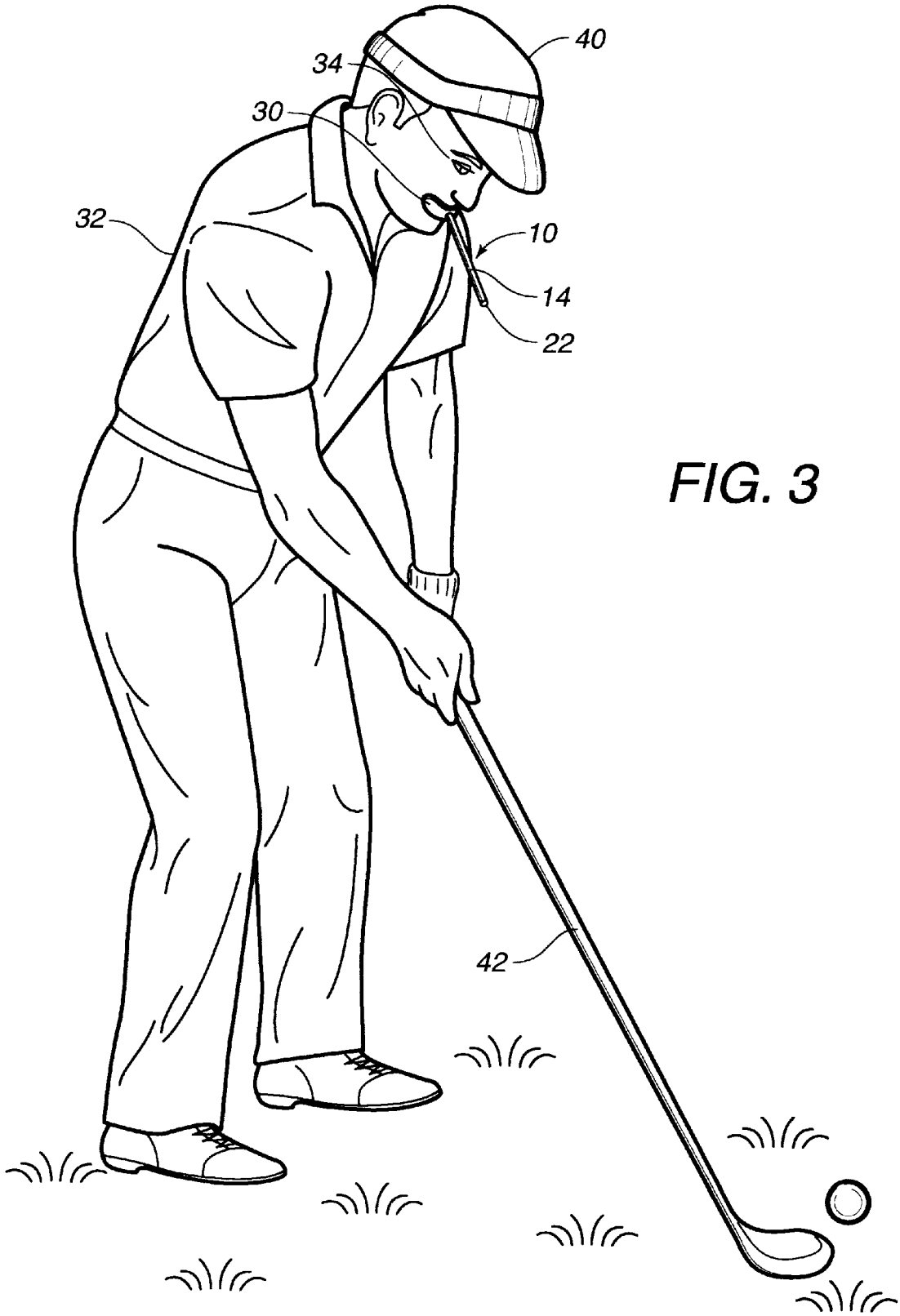
FIG. 3 is a perspective view showing the head positioning device as being used by a golfer during the golf swing.

FIG. 3 shows the operation of the head positioning device 10 in accordance with the teachings of the present invention. In FIG. 3, it can be seen that the shaft 14 of the head positioning device 10 extends outwardly from the mouth 30 of the golfer 32. The distal end 22 of the shaft 14 is positioned so as to be in the line-of-sight between the eyes 34 of golfer 32 and the golf ball 36. During actual use, the golfer 32 will initially position himself or herself a desired distance from the golf ball 36. So as to assure that head 40 is in a desired position, the golfer will move his head 40 such that the distal end 22 is located in the line-of-sight between eyes 34 and golf ball 36. In this manner, the golfer will know that his or her head is in a proper position. The golfer 32 will maintain his or her head 40 in this desired position during the golf swing. In particular, during the backswing, the distal end 22 will remain in the line-of-sight. The distal end 22 will also remain in the line-of-sight while the golfer takes his swing such that golf club 42 contacts golf ball 36. Following contact between the golf club 42 and the golf ball 36, the golfer 32 can move his or her head so as to follow the path of the golf ball 36. The golfer can then easily remove the head positioning device 10 from his or her mouth and store the device in a pocket or golf bag. The head positioning device 10 can then be pulled out and reused on the next swing.

Unlike the prior art, the head positioning device 10 of the present invention allows the body of the golfer to remain in a natural uncontorted position. Since the head positioning device 10 does not fix the head 40 to the golfer's body, in any way, the head 40 can move without restraint. Some golf shots require that the head 40 move following the striking of the golf ball 36 with the golf club 42.

The present invention gives a fixed point of reference so that one can more easily tell if the head 40 is moving. The point of reference is the distal end 22 of shaft 14 at a location outside of the head 40 of the golfer 32. In the prior art, the head 40 will move if the torso or body moves. If the head 40 is fixed in a relative position to the body, then it is impossible to know if either the head or body has moved. In the present invention, one can easily tell if the head 40 is moving since the distal end 22 will move out of the line-of-sight with the golf ball 36.

In the present invention, the head 40 will go to the same relative position at the beginning of each golf swing. As long as the golfer's position is at the same location from the golfball 36, the head positioning device 10 will assure that the head 40 goes to a virtually identical position during each golf swing.

The present invention helps the golfer to visualize the proper swing plane. The present invention allows the head 40 to move without restriction. The head positioning device 10 serves to hold the chin of the golfer 32 on the proper side of the golf ball. The position of the shaft 14 as extending out of the mouth 30 of the golfer 32 will keep the chin from moving in front of the golf ball 36.

Since the head positioning device 10 is formed of a polymeric material, it can be easily manufactured at minimal expense. The small size and light weight of the device 10 allows it to be easily carried and used without discomfort.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A method of training a golf swing comprising:

forming a mouthpiece having a straight shaft of constant diameter extending outwardly therefrom;

placing said mouthpiece into a mouth of a golfer such that said shaft extends outwardly of the mouth of the golfer; and moving a head of the golfer until an end of said shaft opposite said mouthpiece is in a line-of-sight between an eve of the golfer and the golf ball.

2. The method of claim 1, said step of moving further comprising:

continuously pointing said shaft toward said golf ball during a time period between a beginning of the golf swing and until contact is made between the golf club and the golf ball.

3. The method of claim 1, further comprising:

removing said mouthpiece from the mouth following the golf swing.

4. The method of claim 1, said step of forming comprising:

affixing the shaft centrally to an outer surface of said mouthpiece such that said shaft extends radially outwardly of said mouthpiece.

5. The method of claim 4, said step of forming comprising:

forming said shaft so as to have a length of between four inches and eighteen inches.

* * * * *